US005603384A

United States Patent [19]

Bethel et al.

[11] Patent Number: 5,603,384

[45] Date of Patent: Feb. 18, 1997

[54] UNIVERSAL PERFORATING GUN FIRING HEAD

[75] Inventors: Robert K. Bethel, Houston; David G. Hosie, Sugar Land; Michael B. Grayson, Houston, all of Tex.

[73] Assignee: Western Atlas International, Inc., Houston, Tex.

[21] Appl. No.: 540,799

[22] Filed: Oct. 11, 1995

[51] Int. Cl.[6] ..... E21B 43/117

[52] U.S. Cl. ..... 175/4.54; 175/4.56

[58] Field of Search ..... 175/4.54, 4.56, 175/4.52, 4.58; 166/297, 299, 55.2

[56] References Cited

U.S. PATENT DOCUMENTS

| | | | |
|---|---|---|---|
| 4,351,590 | 7/1985 | Peterson | 175/4.52 |
| 4,648,470 | 3/1987 | Gambertoglio | 175/4.54 |
| 4,836,109 | 6/1989 | Wesson et al. | 102/312 |
| 4,911,251 | 3/1990 | George et al. | 175/4.54 |
| 5,050,672 | 9/1991 | Huber et al. | 166/55 |
| 5,355,957 | 10/1994 | Burleson et al. | 166/297 |
| 5,490,563 | 2/1996 | Wesson et al. | 166/297 |

*Primary Examiner*—Frank Tsay
*Attorney, Agent, or Firm*—Alan J. Atkinson

[57] ABSTRACT

A firing head for actuating an explosive charge in a perforating gun. A firing pin is positioned within the firing head housing to actuate a booster charge leading to the perforating gun. The firing pin can be actuated by mechanical techniques, by controlling the differential pressure between the housing pressure and the well pressure, and by controlling the absolute fluid pressure inside the housing. A release pin initially secures the firing pin, and the release pin can be mechanically actuated. The release pin is also releasably engaged with a differential piston that communicates with the well pressure through a port in the firing head housing. Increases in the housing fluid pressure moves the piston and attached release pin to release the firing pin into contact with the booster charge. Alternatively, the port can be plugged to permit absolute pressure actuation of the firing pin.

20 Claims, 2 Drawing Sheets

UNIVERSAL PERFORATING GUN FIRING HEAD

BACKGROUND OF THE INVENTION

The present invention relates to perforating guns for perforating well casing in a hydrocarbon producing well. More particularly, the present invention relates to an improved firing head that can be actuated mechanically or with differential fluid pressure or with absolute fluid pressure to detonate a perforating gun downhole in a well.

In the production of oil and gas from a subsurface geologic formation, well casing is typically installed in a borehole drilled in the formation. To produce hydrocarbon fluids from the formation, the well casing is perforated with a perforating gun containing multiple shaped explosive charges actuated by a firing head. When the firing head is actuated, a primary explosive is detonated and ignites a booster charge connected to a primer cord. The primer cord transmits a detonation wave to the shaped charges, which are activated to create explosive gas jets for penetrating well casing and the surrounding geologic formations.

Existing firing heads are actuated with mechanical, hydraulic, or electrical mechanisms. Certain mechanical firing heads are actuated by dropping or by pumping a weight (termed a "go devil") into the well tubing. The weight moves through the well tubing and impacts a piston to drive a firing pin into an initiator charge. Other mechanical firing heads drop the weight to release a firing pin retainer so that fluid within the well tubing can force the firing pin into the initiator charge. For example, U.S. Pat. No. 4,924,952 to Schneider (1990) disclosed a detonation assembly which was activated with a wireline tool or a weight to mechanically release a fluid biased firing pin into contact with the detonating head.

Differential pressure firing heads react to a differential pressure between the tubing fluid pressure and the annulus pressure in the annulus between the tubing string and the well casing. When the tubing pressure exceeds the casing pressure by a selected amount, the firing gun is activated to detonate the perforating guns. Typically, a lock holds a firing pin in position to prevent premature detonation of the perforating guns. When the tubing pressure exceeds the annulus pressure, the lock releases the firing pin, and the tubing pressure drives the firing pin into contact with the detonator. In U.S. Pat. No. 4,836,109 to Wesson et al. (1989) a differential pressure actuating piston communicated on the high pressure side to a position below the packer and communicated on the low pressure side with an isolated zone in the well. In U.S. Pat. No. 4,509,604 to Upchurch (1985), a differential pressure actuating piston communicated on the high pressure side to a position above the packer and communicated on the low pressure side with the isolated zone in the well.

U.S. Pat. No. 4,911,251 to George et al. (1990), disclosed a firing head actuated by mechanical or hydraulic force generated by the combined operation of three pistons. An actuator piston was impacted by a go devil or actuated with a wireline tool. The mechanical release of the actuator piston released a first firing piston so that the tubing fluid pressure could drive the first firing piston into the initiator charge. Alternatively, the fluid pressure within the tubing could be increased against a second firing piston to drive the second firing piston and the attached first firing piston into contact with the initiator charge. The differential pressure operating against the second firing piston was the tubing pressure minus the lower pressure in a sealed housing recess.

A similar hydraulic actuation concept was disclosed in U.S. Pat. No. 4,969,525 to George et al. (1990), where a differential pressure piston was moved to release a firing pin. The high pressure side of the piston communicated with the isolated well zone, and the low pressure side of the piston communicated with a sealed chamber charged with atmospheric pressure. A mechanical or hydraulic backup firing head was positioned above the principal firing head and was attached to the booster charge with a backup detonating cord. If the backup firing head was hydraulically operated, the actuation pressure could be set at a level different than that of the principal firing head to control the firing sequence of the firing heads.

In U.S. Pat. No. 5,050,672 to Huber et al. (1991) a perforating gun was attached to the tubing string and run into the well without a firing head. A differential pressure firing head was lowered to a position proximate to the perforating gun and could be separately withdrawn from the well if the firing head did not operate.

Electrically actuated firing heads have been used to detonate perforating guns. U.S. Pat. No. 5,115,865 to Carisella et al. (1992) describes different electrical detonation techniques and discloses safety techniques for preventing the untimely detonation of the perforating guns.

In U.S. Pat. Nos. 5,287,924 and 5,355,957 to Burleson et al. (1994), first and second pressure actuated firing heads were positioned downhole in a well, and an actuating fluid pressure was selectively isolated from the second firing head until the first firing head was actuated. This concept provides a technique for the selective perforation of multiple well zones. Actuation fluid pressure for the firing heads of each gun was provided through the bore of the tubing string, and the operating pressure for each firing head was determined by the number of shear pins retaining each firing piston.

In U.S. Pat. No. 5,366,014 to George (1994), a modular perforating gun system permitted the installation, actuation and removal of multiple perforating gun modules conveyed on coiled tubing or other mechanisms.

The use of different style firing heads for perforating guns typically requires the storage and use of mechanical and hydraulic firing heads. The cost resulting from firing head failure encourages secondary backup firing heads in the well, which increases tool string length and well operator cost. Accordingly, a need exists for a combined firing head that can reliably operate by mechanical and hydraulic operation, and that automatically provides backup firing capability.

SUMMARY OF THE INVENTION

The present invention provides an improved firing head for actuating an explosive charge in a downhole perforating gun positioned in a well. A hollow housing has a port for communicating pressure between the well and an interior space within the housing. A firing pin is positioned for impacting the explosive charge, a release pin initially secures the firing pin, and the release pin is moveable to actuate the firing pin. A piston is releasably engaged with the release pin, and the piston is moveable in response to pressure changes within the housing to move the release pin to actuate the firing pin.

In other embodiments of the invention, a first retainer can initially secure the firing pin, and a second retainer can releasably attach the release pin to a differential piston. Movement of the differential piston causes the release pin to actuate the firing pin, and mechanical actuation of the release pin can alternatively disengage the release pin from the differential piston to actuate the firing pin.

The invention permits the actuation of the firing pin by controlling the differential pressure between the housing interior and the well, and by mechanical techniques. Additionally, the housing port can be plugged in another embodiment of the invention to actuate the firing pin based on the absolute pressure within the housing.

DESCRIPTION OF THE PREFERRED EMBODIMENTS

Figure 1:
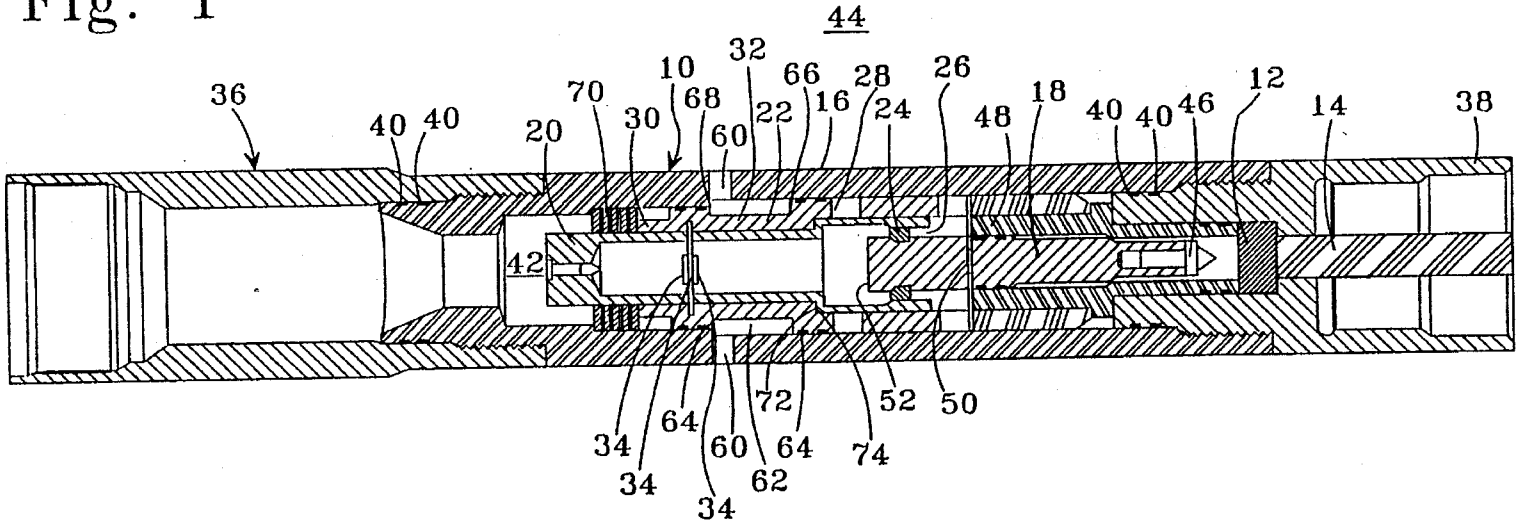
FIG. 1 illustrates a sectional view of the invention.

The present invention provides an improved firing head for actuating a perforating gun. Referring to FIG. 1, firing head 10 operates to ignite booster charge 12 attached to primer cord 14. As is known in the art, the detonation of booster charge 12 generates a detonation wave transmitted through primer cord 14 to detonate shaped charges (not shown).

Firing head 10 generally comprises housing 16, firing pin 18, release pin 20, and piston 22. Firing pin 18 is initially secured with release pin 20 and is actuated by movement of release pin 20 within housing 16. Release pin 20 can include spring retainer 24 which initially engages recess 26 in firing pin 18. Movement of release pin 20 in either longitudinal direction within housing 16 actuates retainer 24 to disengage from recess 26, thereby releasing firing pin 18 to move within housing 16 toward booster charge 12.

In one embodiment of the invention as shown in FIG. 1, piston 22 comprises a differential piston having first end 28 and second end 30, and middle section 32. Although piston 22 is shown as a differential piston, piston 22 can have the same size ends in different configurations of the invention. Piston 22 is releasably attached to release pin 20 by a retainer shown as shear pins 34. Housing 16 is attached to tubing 36 and to perforating gun 38. Seals 40 close the annulus between housing 16, tubing 36 and perforating gun 38. Fluid 42 is contained within the interior of housing 16, and fluid 44 is present outside of housing 16. Fluid 44 is generally defined herein as the "well fluid" and includes any fluid or gas existing outside of housing 16, as more completely described below. Where a well casing has been installed, fluid 44 comprises a fluid in the annulus between the exterior surface of housing 16 and the interior surface of the well casing. In a cased well having annulus packers above and below firing head 10, fluid 44 may comprise a gas such as atmospheric air that provides a low pressure sink. In other configurations and uses, fluid 44 may communicate with other areas within the well above a packer, below a packer, can communicate with equipment at the well surface, or can communicate with different geologic zones.

Firing pin 18 includes firing head 46 for contacting booster charge. If desired, housing insert 48 can be positioned within or can comprise part of housing 16, and shear pin 50 can initially hold firing pin 18 in a fixed position relative to booster charge 12. Firing pin 18 has a fluid contact end 52 for contacting fluid 42 so that the hydrostatic pressure of fluid 42 exerts a force against fluid contact end 52.

Figure 2:
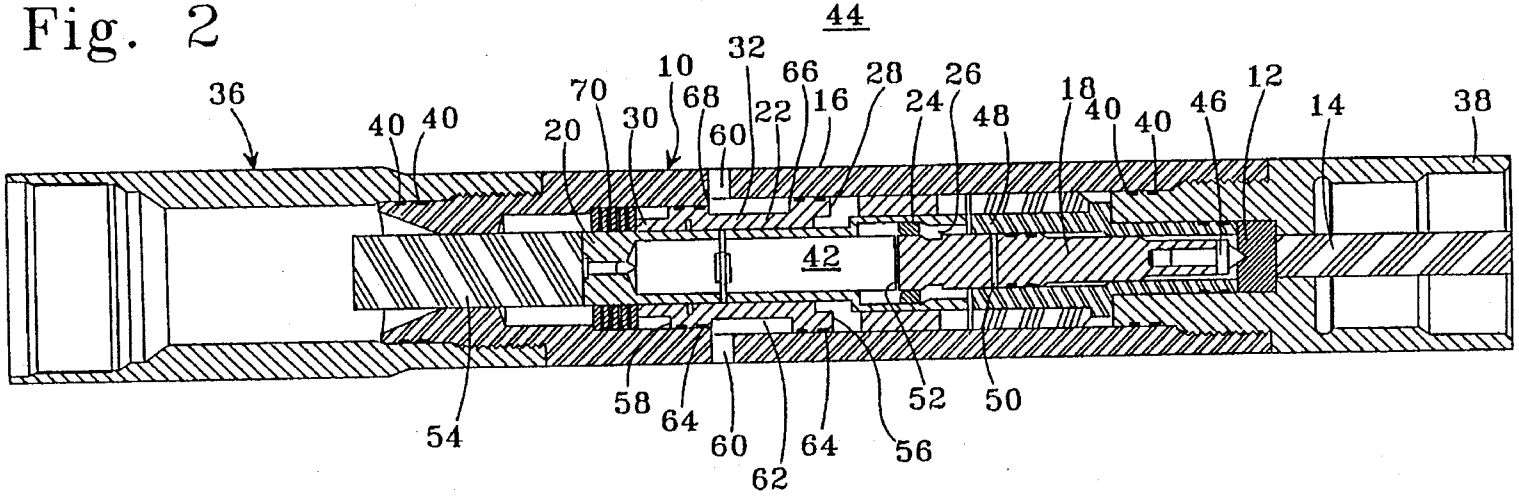
FIG. 2 illustrates an embodiment of the invention after the release pin has been mechanically actuated with a moving weight.

Referring to FIG. 2, an embodiment of the invention is illustrated wherein firing pin 18 has been actuated with moving weight 54. Weight 54 can be dropped from the well surface in a substantially vertical well and can be pumped through tubing 36 in a slanted or horizontal well. When weight 54 contacts release pin 20, weight 54 exerts a force which breaks shear pins 34 and drives release pin 20 toward booster charge 12. Release pin 20 disengages retainer 24 from recess 26, and the hydrostatic pressure of fluid 42 contacts fluid contact end 52 to drive firing pin 18 against booster charge 12 as shown in FIG. 2.

Instead of weight 54, other mechanical techniques can be used to move release pin 20. Such techniques included wirelines, slick lines, tubing controlled operations, and other techniques known in the art.

Figure 3:
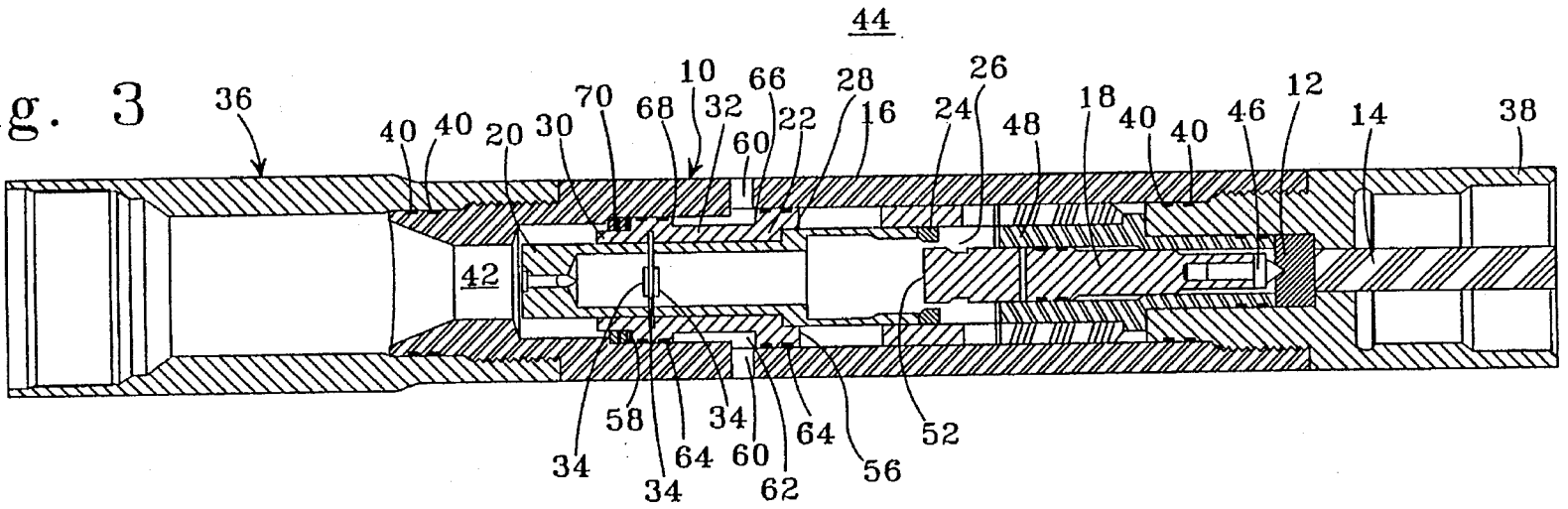
FIG. 3 illustrates an embodiment of the invention wherein the differential piston has been actuated by the differential between the housing pressure and the well pressure.

FIG. 3 shows another operation of firing tool 10 wherein the differential pressure between fluid 42 and fluid 44 is controlled to actuate firing pin 18. In this embodiment of the invention, the pressure of fluid 42 exerts a force against surfaces 56 and 58. The difference in surface area contact multiplied by the pressure of fluid 42 generates a resultant force caused by fluid 42. Port 60 in housing 16 communicates well fluid 44 into space 62 within housing 16. As shown in FIG. 3, well fluid 44 contacts middle section 32 of piston 22. Fluid 44 is contained within space 62 by seals 64, contacts piston surfaces 66 and 68, and generates a resultant force against piston 22. If the pressure of fluid 44 within space 62 is lower than the pressure of fluid 42, a resultant force is exerted against piston 22 which operates to move piston 22 from the initial position shown in FIG. 1.

As shown in FIG. 3, the pressure of fluid 42 has been increased to a level where the differential pressure between fluid 42 and fluid 44 creates a resultant force which urges second end 30 of piston 22 to shear retainer 70, thereby permitting movement of piston 22 away from booster charge 12. As piston 22 moves in such direction within housing 16, shear pins 34 hold release pin 20 relative to piston 22 and move release pin 20 accordingly. Such movement of release pin 20 actuates retainer 24 to disengage from recess 26, thereby releasing firing pin 18 to contact booster charge 12.

The pressure of fluid 42 can be controlled from the well surface to create a sufficient pressure differencial between fluid 42 and fluid 44 to move piston 22. The orientation of such components and the relative pressures of fluid 42 and fluid 44 can be modified to change the direction of movement of piston 22 and release pin 20. As one illustrative example, the pressure of fluid 42 could be lowered below that of fluid 44 to move piston 22 toward booster charge 12. In such example, shear pins 34 would hold release pin 20 relative to piston 22, and piston shoulder 72 would contact pin release shoulder 74 to urge release pin 20 toward booster charge 12. Such movement would disengage retainer 24 and permit firing pin 18 to contact booster charge 12 as previously described.

Figure 4:
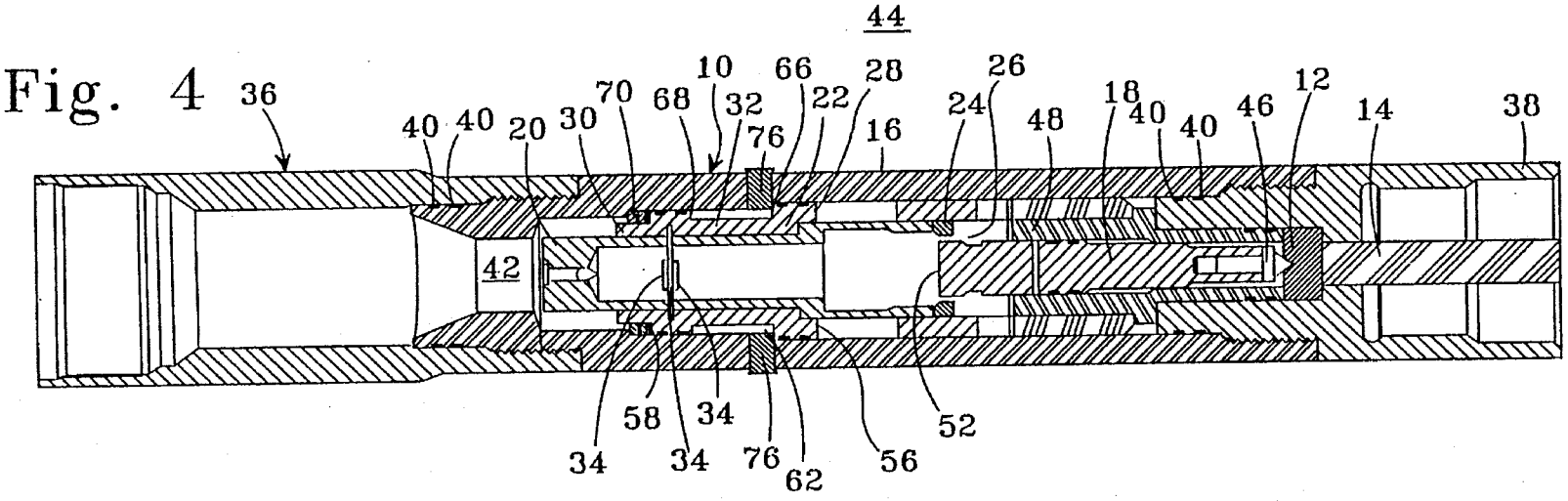
FIG. 4 illustrates an embodiment of the invention wherein the ports are plugged so that the firing pin is actuated by the absolute pressure within the housing.

FIG. 4 illustrates another operation of the invention wherein plugs 76 are positioned in ports 60. In this configuration, the pressure of fluid 42 can be increased to a selected level sufficient to break shear retainer 70. Accordingly, the invention operates based on absolute fluid pressure causing piston 22 and attached release pin 20 to move in the same sequence described above for the differential pressure operation. Although plugs 76 can be installed at the well surface, plugs 76 could also comprise a valve controlled remotely from the well surface. This feature of the invention permits hyraulic operation of firing head 10 regardless of pressure fluctuations in fluid 44.

The invention provides a unique apparatus for permitting one firing head tool to be actuated mechanically, with differential fluid pressures, and with absolute fluid pressure control. This combination of operational flexibility permits one tool to be used in any application, eliminates the need for multiple firing heads in the wellbore, and provides internal backup firing head capability in the event that the primary firing sequence fails. For example, failure of the pressure actuated firing operation could be overcome by mechanically operating the release pin to actuate the firing pin, or by closing ports 60 to permit absolute pressure actuation of firing head 10.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An improved firing head for actuating an explosive charge in a perforating gun positioned downhole in a well, comprising:

a hollow housing having a port for communicating pressure between the well and an interior space within said housing;

a firing pin for impacting the explosive charge;

a release pin for securing said firing pin, wherein movement of said release pin actuates said firing pin to contact the explosive charge;

a piston releasingly engaged with said release pin, wherein said piston is moveable in response to pressure changes within said hollow housing to selectively move said release pin to actuate said firing pin, and wherein said release pin is mechanically releasable from engagement with said piston to selectively move said release pin to actuate said firing pin.

2. A firing head as recited in claim 1, wherein said piston is moveable in response to a differential pressure between the pressure within said hollow housing and the pressure outside of said housing.

3. A firing head as recited in claim 1, wherein said piston is moveable in response to a selected pressure increase within said housing.

4. A firing head as recited in claim 1, further comprising a piston retainer for initially securing said piston to said housing, wherein said piston retainer releases said piston when the pressure within said housing reaches a selected level.

5. A firing head as recited in claim 1, wherein said release pin can be contacted by a moving weight within said housing to mechanically release from engagement with said piston.

6. A firing head as recited in claim 1, wherein said release pin can be actuated by a wireline tool to mechanically release said release pin from engagement with said piston.

7. A firing head as recited in claim 1, further comprising a valve for selectively closing the port in said hollow housing.

8. An improved firing head for actuating an explosive charge in a perforating gun positioned downhole in a well, comprising:

a hollow housing for containing a fluid pressurized from the well surface;

a firing pin within said housing for impacting the explosive charge;

a first retainer for securing said firing pin;

a release pin engaged with said retainer for securing said firing pin, wherein movement of said release pin releases said retainer to permit said firing pin to contact the explosive charge;

a differential piston within said housing which is moveable in response to changes in the fluid pressure within said housing;

a port in said housing for communicating the well pressure to said differential piston; and a second retainer for releasably engaging said differential piston and said release pin, wherein said second retainer attaches said release pin to said differential piston to release said first retainer when said differential piston is moved by the fluid pressure changes, and wherein said second retainer disengages said release pin from engagement with said differential piston when said release pin is mechanically actuated.

9. A firing head as recited in claim 8, wherein said port communicates the well pressure to a low pressure end of said differential piston.

10. A firing head as recited in claim 8, wherein said port communicates the well pressure to an interior space within said housing, and wherein said interior space constitutes the low pressure side of said differential piston.

11. A firing head as recited in claim 8, wherein said release pin is positioned concentrically within the interior of said differential piston.

12. A firing head as recited in claim 8, further comprising a piston retainer for initially securing said piston to said housing, wherein said piston retainer releases said differential piston when the pressure within said hollow housing reaches a selected amount.

13. A firing head as recited in claim 8, further comprising a valve actuatable from the well surface for selectively closing said port.

14. A firing head as recited in claim 8, further comprising a plug for selectively closing said port.

15. An improved firing head for actuating an explosive charge in a perforating gun positioned downhole in a well, comprising:

a hollow housing for containing a fluid pressurized from the well surface;

a firing pin within said housing for impacting the explosive charge;

a first retainer for securing said firing pin;

a release pin engaged with said retainer for securing said firing pin, wherein movement of said release pin releases said retainer to permit said firing pin to be forced by the pressurized fluid into contact with the explosive charge;

a differential piston within said housing and concentrically positioned about said release pin, wherein said differential piston is movable in response to changes in the fluid pressure within the housing;

a port in said housing for communicating the well pressure to said differential piston, and a second retainer for releasably engaging said differential piston and said release pin, wherein said second retainer attaches said release pin to said diferential piston to release said first retainer when said said differential piston is moved by the fluid pressure changes, and wherein said second retainer disengages said release pin from engagement with said differential piston when said release pin is mechanically actuated.

16. A firing head as recited in claim 15, further comprising a plug for selectively blocking said port.

17. A firing head as recited in claim 15, wherein said port communicates the well pressure to a low pressure end of said differential piston.

18. A firing head as recited in claim 15, further comprising a piston retainer for initially securing said piston to said housing, wherein said piston retainer releases said differential piston when the pressure within said hollow housing reaches a selected amount.

19. A firing head as recited in claim 15, wherein said release pin can be contacted by a moving weight within said housing to mechanically release from engagement with said differential piston.

20. A firing head as recited in claim 1, wherein said firing pin is urged by pressure within said hollow housing to contact the explosive charge after said first retainer releases said firing pin.

* * * * *